United States Patent [19]

Terry et al.

[11] Patent Number: 4,593,545

[45] Date of Patent: Jun. 10, 1986

[54] LEVER LOCK SAFETY DEVICE

[75] Inventors: Edmund A. Terry, Barking; Albert J. Burger, Bromley; Peter A. Terry, Hornchurch, all of United Kingdom

[73] Assignee: P. A. Terry Limited, London, England

[21] Appl. No.: 546,386

[22] Filed: Oct. 28, 1983

[30] Foreign Application Priority Data

Oct. 28, 1982 [GB] United Kingdom ..... 8230868
Apr. 7, 1983 [GB] United Kingdom ..... 8309443

[51] Int. Cl.[4] ..... E05B 43/00

[52] U.S. Cl. ..... 70/269; 70/283; 70/354

[58] Field of Search ..... 70/134, 269, 271, 272, 70/283, 354, DIG. 30, DIG. 45; 292/144, 201, 57–66, 68, 69

[56] References Cited

U.S. PATENT DOCUMENTS

| | | | |
|---|---|---|---|
| 457,872 | 8/1891 | Simon | 70/354 |
| 908,813 | 1/1909 | Stevens | 70/283 |
| 3,642,313 | 2/1972 | Anderson | 292/66 |
| 4,095,827 | 6/1978 | Stavenau | 292/65 |

FOREIGN PATENT DOCUMENTS

| | | | |
|---|---|---|---|
| 967614 | 5/1975 | Canada | 70/269 |
| 2310612 | 9/1973 | Fed. Rep. of Germany | 70/269 |
| 2129865 | 5/1984 | United Kingdom | 70/267 |

*Primary Examiner*—Robert L. Wolfe
*Assistant Examiner*—Russell W. Illich
*Attorney, Agent, or Firm*—Cushman, Darby & Cushman

[57] ABSTRACT

The levers (5) of a lock which retain a bolt (3) in its locking position are prevented from moving to release the bolt by a latching member (12) in its latching position. The latching member (12) is movable along a guide (10) to an unlatching position by action of a solenoid (15). Insertion of the key (6) into the lock operates a switch (20) which actuates a timer operating the solenoid after a delay.

8 Claims, 12 Drawing Figures

LEVER LOCK SAFETY DEVICE

This invention relates to the field of locks of the kind in which a movable bolt is retained in its locking position by at least one movable locking member which normally assumes a rest condition in which it engages with the bolt to prevent its movement, but can be moved out of the rest condition to a bolt-release condition by rotation of a key having an appropriate key-bit shaped to coact with the locking member. The invention has particular, but not exclusive, application to lever locks in which a set of key levers retain the bolt in its locking position.

It is desirable under certain circumstances to have locks, such as safe locks and vault locks, controlled on a timed basis, so that the lock cannot be opened even with the proper key unless the timing means has reached a predetermined "open" period. However, the fixing of predetermined "open" periods can be awkward for the user who desires access at random times. For avoiding this disadvantage, it is already known to have a safety device, for attachment to or incorporation in a lever lock, in which a certain relatively short delay (between insertion of the key and capability of opening the lock) is obtained by means of a clockwork-operated latching mechanism which is wound up by rotation of the key in the lock.

The object of the present invention is to provide an improved safety timer device, primarily for a lever lock, which permits inter alia of (i) having the "delay" period commenced (or re-commenced) automatically at each time of insertion of the key, (ii) completely immobilizing the key levers or other locking member(s) at all times other than during an "open" period which follows the "delay" period, and (iii) wider variation of the "delay" period than provided by the known clockwork-operated latching mechanism.

According to a first aspect of the present invention, there is provided a key-operable lock having a movable bolt which is retained in its locking position by at least one movable locking member engaging the bolt but movable by rotation of a coacting key-bit of the key to release the bolt for movement to an unlocking position, wherein the lock further comprises a latching member movable between a latching position, in which the latching member prevents movement of the locking member to release the bolt, and an unlatching position; latch-control means acting on the latching member to move said member from its latching to its unlatching position; switch means operable by movement of the key in the lock; and a timer actuated by the switch means and acting on the latch-control means to cause movement of the latching member from its latching to its unlatching position after a delay following operation of the switch means.

According to a second aspect of the present invention there is provided a lock control device for attachment to a key-operable lock having a movable bolt which is retained in its locking position by at least one movable locking member engaging the bolt but movable by rotation of a coacting key-bit of the key to release the bolt for movement to an unlocking position, said device comprising attachment means for securing the device to the lock; a latching member adapted to extend into the lock and movable between a latching position, in which the latching member is adapted to prevent movement of the locking member to release the bolt, and an unlatching position; latch-control means acting on the latching member to move said member from its latching to its unlatching position; switch means adapted to be operated by movement of the key in the lock; and a timer actuated by the switch means and acting on the latch-control means to cause movement of the latching member from its latched to its unlatched position after a delay following operation of the switch means.

As mentioned previously, the invention has particular application to lever locks, in which a set of key levers constitute the at least one locking member and serve to retain the bolt in its locking position. This type of lock is widely used to secure safes, vaults, strong rooms and the like high security zones.

Usually, the locking member will be resiliently biassed into its latching position by, for example, a helical tension spring or a torsion coil spring.

The latching member may comprise, for example, a cam or bar engaging an outer surface of the locking member or an inner surface defining an aperture in the locking member. However, it is preferred that the latching member comprises a bar which, in its locking position, extends across the path of movement of the locking member to act as an abutment preventing movement of the locking member from its locking position. Usually, the bar is movable laterally to its unlatching position and it is preferred that said lateral movement is along a guide.

Advantageously, the bar also extends across the said path when it is in its unlatching position and the guide extends beyond the unlatching position of the bar to permit further movement of the bar with the locking member as the latter moves to its unlocked position. Suitably, the guide is L-shaped and the bar in its unlatching position is at the junction of the guide limbs. The guide conveniently can be a slot provided in a wall of the lock casing.

Preferably, the latch-control means is electrically powered and usually will comprise a solenoid in an electrical circuit with the switch means and the timer. It is also preferred that the latch-control means is time-controlled so that it retains the latching member in its unlatching position only for a predetermined time interval, e.g. 30 seconds to 3 minutes and thereafter allows or causes said member to return to its latched position. In order to reduce the risk of burning out electrically powered means such as the solenoid during such time interval, provision can be made to reduce the voltage applied from an operating voltage, e.g. 24 volts, to a holding voltage, e.g. 9–12 volts.

In a preferred embodiment of the invention, the latching member comprises a laterally movable bar as aforementioned, the latch-control means comprises a solenoid as aforementioned and the solenoid is articulately connected to the bar by a connecting rod which extends substantially perpendicularly from the bar.

A further switch means actuable upon movement of the locking member to its unlocking position advantageously may be provided to break the electrical power supply circuit to the latch-control means. Suitably, said switch means is actuated by movement of the latching member to a position beyond its unlatching position and corresponding to the unlocked position of the locking member.

The key-operated switch means may be actuated by rotation of the key in the lock but preferably is actuated by insertion of the key. Suitably such switch means has an actuator aligned with the rod of the key and arranged to actuate the switch upon full insertion of the key into the lock.

In order that the nature of the invention may be readily ascertained, embodiments of a lock of the present invention are hereinafter particularly described with reference to the Figures of the accompanying drawings. In the drawings.

Figure 1:
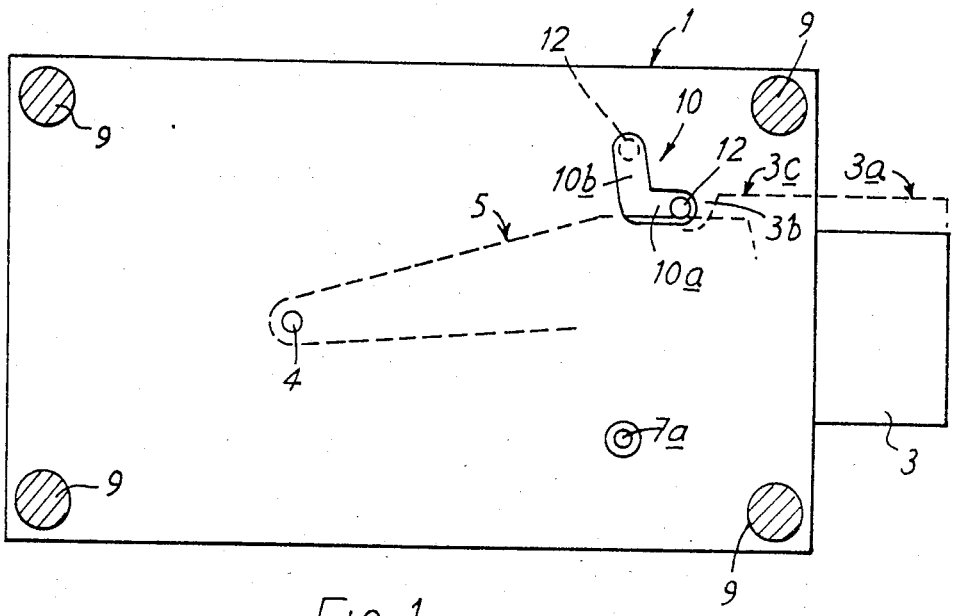
FIG. 1 is a view on the line I—I of FIG. 2 of a lock in accordance with one embodiment of the invention.
Figure 2:
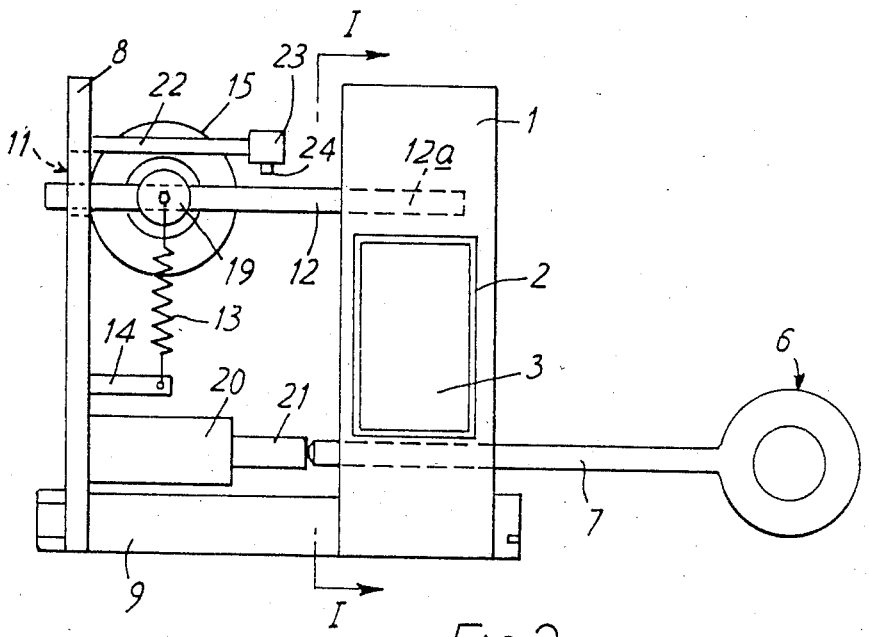
FIG. 2 is an end elevation of the lock of FIG. 1 from which some parts have been omitted for clarity.
Figure 3:
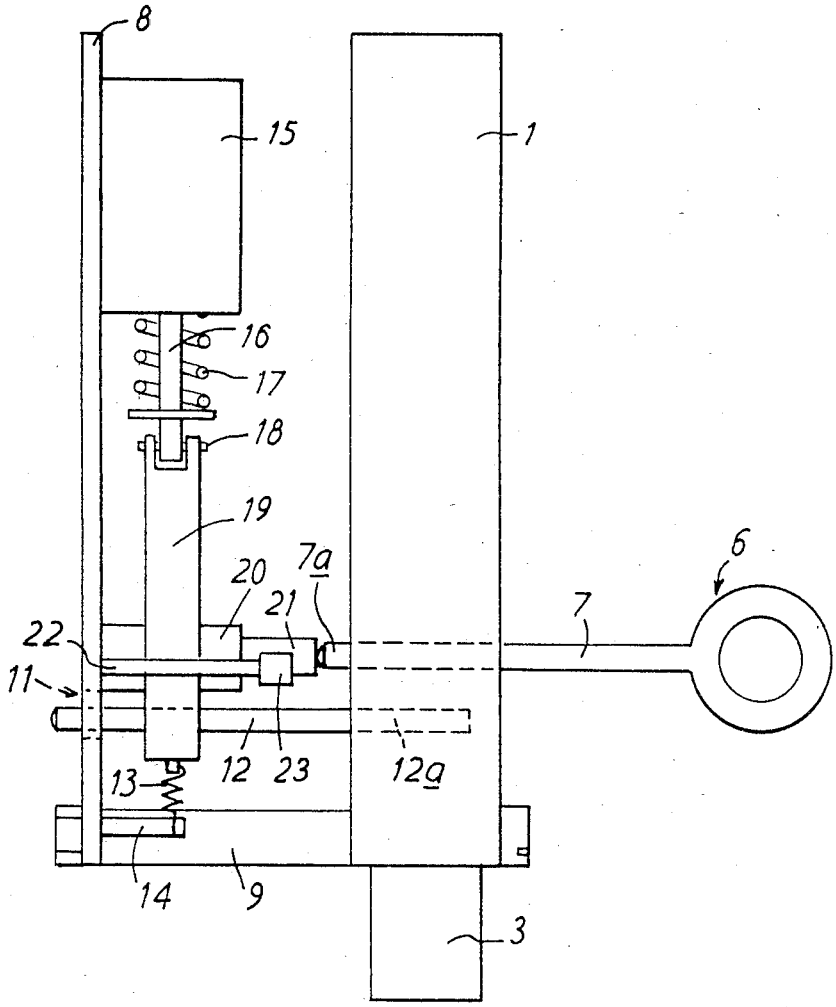
FIG. 3 is a plan view of the lock of FIG. 1 from which some parts have been omitted for clarity.

The lock illustrated in FIGS. 1-3 comprises a lock body 1 having in one end wall a passage 2 in which a bolt 3 can slide into withdrawn and projecting positions, corresponding respectively to unlocked and locked states of the article, such as a safe door, on which the lock is mounted. In these figures, the bolt 3 is seen in its projecting position. The lock mechanism is conventional, to the extent that it includes a plurality of levers 5 which are pivotable about a shaft 4 and which in their rest (i.e. horizontal) position engage with respective internal portions of the bolt 3 to retain the bolt in locked or unlocked position. The levers are raisable, about their pivot axis, by means of a key 6 having the usual shaft 7 on which is provided the usual key-bit having projections of different radial heights adapted to cooperate each with a respective lever. The end of the key shaft projects at 7*a* through the lock body 1. The operation of the lock is normal, in that rotation of the key through approximately 180° causes lifting of the levers to enable the bolt to be slid into the withdrawn or protruding position.

A support plate 8 is mounted at a spacing from the rear face of the lock body 1 by four pillars 9, only one of which is shown for clarity in FIGS. 2 and 3. In the rear face of the lock body (see FIG. 1) there is provided an L-shaped guide aperture 10, the foot zone or limb 10*a* of which corresponds with the position of the upper surface of the levers 5 before they have been raised by the key-bit. A similar guide aperture 11 is provided in the support plate 8, in alignment with the aperture 10. A latching bar 12 is positioned with one end engaged through aperture 10 into the lock body 1 so as to closely overlie all of the levers 5, and with its other end projecting through aperture 11 of the support plate 8. The latching bar is urged downwardly by a spring 13 engaged at its lower end on a fixed stud 14 on the support plate 8. On the inner face of the support plate 8 there is mounted a solenoid 15 whose armature 16 is urged to extended position by a compression spring 17. The free end of the armature 16 is coupled, by a vertically pivotable joint 18 to a rod 19 engaged on the latching bar 12. In its rest condition, the latching bar 12 is seated by its ends in the foot zone or limb 10*a* of the guide aperture 10 and in the corresponding foot zone or limb of the guide aperture 11, to which position it is urged by the compression spring 17 and the tension spring 13. In this position, the end 12*a* of the latching bar 12 situated inside the lock body 1 closely overlies the levers 5 and prevents them from rising, thus securing the lock mechanism against being operated by the key 6.

When the solenoid 15 is energized, the armature 16 is moved inwardly, against the pressure of spring 17, and the latching bar 12 is drawn along the foot limb 10*a* of the aperture 10 and 11 until it is positioned at the base of the upright limb 10*b* and the corresponding portion of aperture 11. In this position, the latching bar 12 can rise, against the small tension of the spring 13, when the key 6 is rotated to lift the levers 5. Thus, so long as the solenoid 15 is energised, the lock can be operated by its key in the usual way.

The bolt 3 may have a greater height, as shown at 3*a* in FIG. 1, and may be cut away, as at 3*b*, so as not to foul the latching bar 12 when the bolt is in the outward locking (i.e. protruding) position illustrated. When the bolt has been moved inwards to the unlocking (i.e. withdrawn) position, the upper surface 3*c* of the bolt then rides under the latching bar 12 to prevent it from passing downwardly in limb 10*b* and then forwardly into limb 10*a*, i.e. to prevent inadvertent latching of the levers 5 when the lock is in the unlocked state.

On the inner face of the support plate 8 there is mounted a micro-switch 20 having its actuator 21 aligned with the protruding end 7*a* of the key shaft 7. When the key shaft 7 is engaged fully into the lock body 1, for normal operation of the lock, the end 7*a* has moved the actuator 21 to close the micro-switch 20.

A stud 22 mounted on the support plate 8 carries a micro-switch 23 having its actuator 24 positioned for engagement by the latching bar 2 when the latter has been raised up the upright zones or limbs of the apertures 10 and 11 by the lifting of the levers 5. The micro-switch 23 is normally closed-circuit, and is in circuit with the current feed to the solenoid 15. When the actuator 24 is moved upwardly by the latching bar 12, the micro-switch is made open-circuit and the feed of current to the solenoid is cut off. The actuator 24 is spring-urged (not shown) towards its closed-circuit condition.

The micro-switch 20 is arranged in an electronic time-delay circuit having a delay period which is variable from, say, 3 minutes to 1 hour. Engagement of the key fully into position in the lock body 1 causes actuation of the micro-switch 20 and the delay period commences. During this delay period, the key cannot be rotated to open the lock, because the latching bar 12 is in the foot limbs of the apertures 10 and 11 and thus prevents the key levers 5 from rising. At the end of the predetermined delay period, the time-delay circuit switches a current feed to the solenoid 15, causing the latching bar 12 to be drawn along the foot limbs of the apertures 10 and 11. The latching bar 12 is then free to ride up the upright position of the apertures 10 and 11, and accordingly the levers 5 can rise, when the key is turned, to permit movement of the bolt 3. As soon as the levers 5 have risen sufficiently, the latching bar 12 strikes the actuator 24 of the micro-switch 23, and current feed to the solenoid is cut off, thereby saving wastage of current. As soon as the key levers 5 have returned to their lower position, the latching bar 12 has also travelled downwardly, under the action of tension spring 13, and is then projected along into the foot limbs of aperture 10 and 11 by the thrust of the compression spring 17.

The time-delay circuit also provides a predetermined "open" period, which might be varied from, say, 30 seconds upwards, of the current feed to the solenoid 15. If the key has not been rotated, during the "open" period permitted, the solenoid ceases to be energised and the latching bar 12 travels back to the retaining position in the manner described above.

If the key 6 is removed and re-inserted, during the "open" period permitted, the actuation again of the micro-switch 20 commences a new delay period during which the lock cannot be operated.

As the key levers 5 are held against rising, by the latching bar 1, at all times when the solenoid 15 is not energised, there is no possibility of the lock being picked, except during an "open" period. This period can be made very short, and in any event the key must be in position for it to occur.

The lock cannot be forced open by forced rotation of the key, because the key levers 5 are secured against upward movement by the latching bar 12 seated in the foot limbs of the apertures 10 and 11.

If the key is rotated so forcefully as to break it, the lock can be operated normally after removal of the broken key and insertion of another replacement key.

Additional optional features which may advantageously be included are:

(i) buzzer or LED warning of "open" period and/or run-down of batteries providing the current feeds.
(ii) provision of a constant re-charging of current-supply batteries, from the main supply.
(iii) operation directly by a mains-fed current-feed system.
(iv) the time-delay circuitry may be additionally arranged on a 24-hour clock basis to provide one or more pre-set user times.
(v) the time delay circuitry may be arranged on a 24-hour basis to prevent operation during a selected night-time period.
(vi) An L.C.D. clock may be provided, to include operation of item (v) above.

Figure 4:
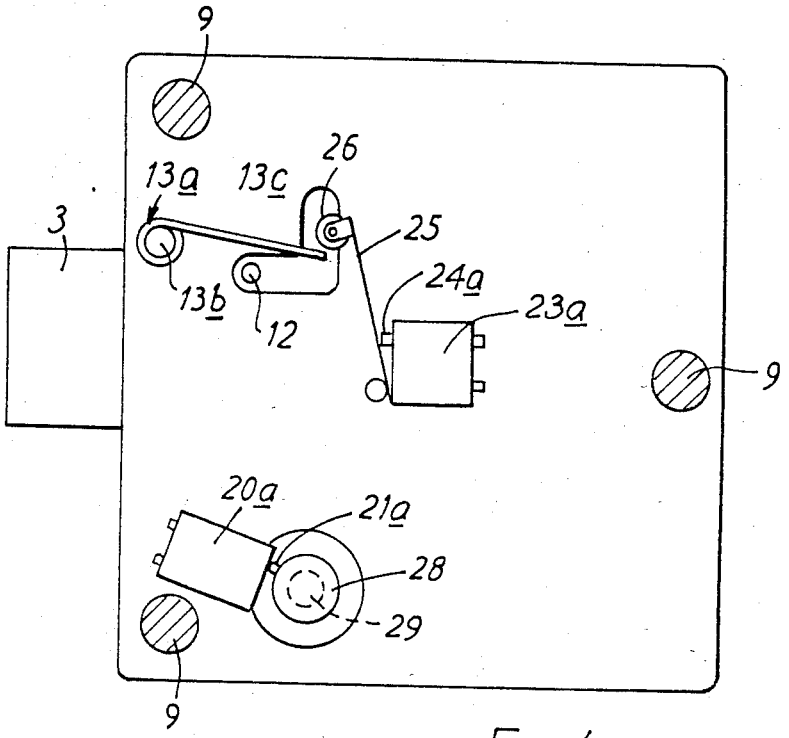
FIG. 4 is a view on the line IV—IV of FIG. 5 of a lock in accordance with another embodiment of the invention.
Figure 5:
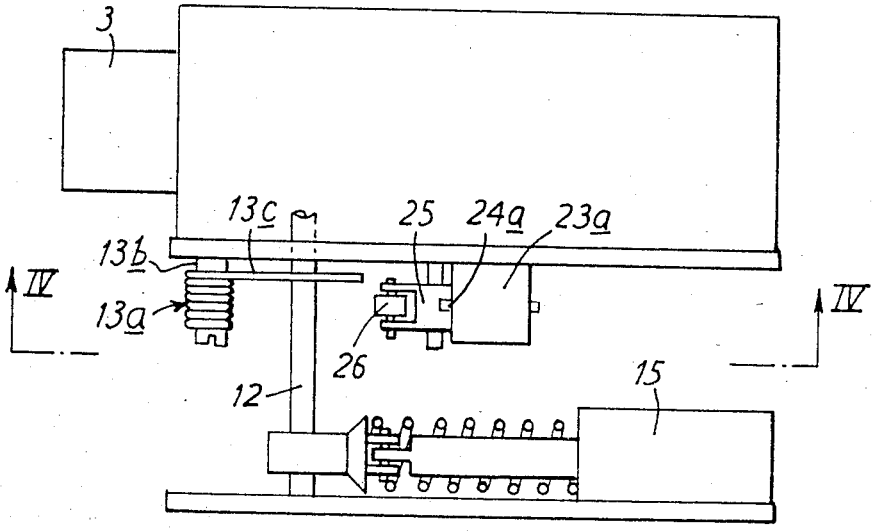
FIG. 5 is a plan view of the lock of FIG. 4 from which some parts have been omitted for clarity.
Figure 6:
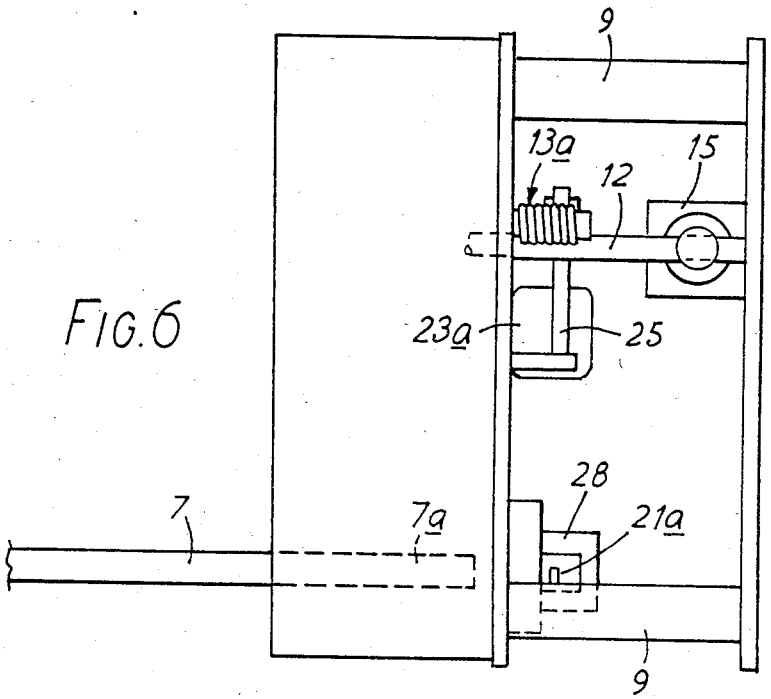
FIG. 6 is an end elevation of lock of FIG. 4 from which some parts have been omitted for clarity.
Figure 7:
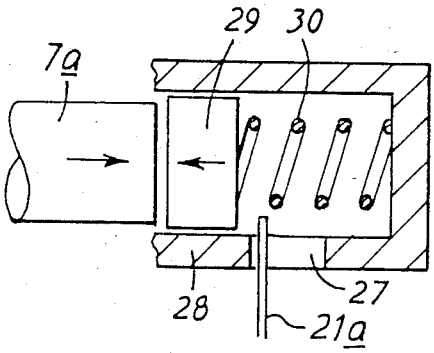
FIG. 7 is a detail sectional view, to an enlarged scale, of the key-operated switch means of the lock of FIG. 4.

Referring now to FIGS. 4 to 7, there is shown a second embodiment which has minor variations of some of the items shown in FIGS. 1 to 3. In the lock of FIG. 1 there is a spring 13 which has the function of urging the latching bar downwardly. In the lock of FIG. 4, the tension spring 13 is replaced by a torsion spring **13*a* which is mounted on a pillar 13*b* and has one end secured in a transverse slot of the pillar, and the other free end 13*c* positioned to bear down on the latching bar 12**.

In the lock of FIG. 1 there is a micro-switch 23 having its actuator 24 positioned to be engaged by the latching bar 12 when the latter has been raised up the upright zone of the apertures 10 and 11. In the lock of FIG. 4, that arrangement is replaced by a micro-switch having its actuator **24*a* abutted by a resilient arm 25 carrying a roller 26 which is contacted and moved by the latching bar 12 as it rises up the vertical zone 10*b* of the slot 10**.

In the lock of FIG. 1 there is a micro-switch 20 having its actuator 21 aligned with the protruding end **7*a* of the key shaft 7, thereby to cause the micro-switch to close when the key is fully inserted. In the lock of FIG. 4, the micro-switch 20 and the actuator 21 are replaced by a micro-switch 20*a* having its actuator 21*b* entering a lateral slot 27 in a housing 28 in which is arranged a plunger 29 loaded by a compression spring 30 to move in the direction of the arrow. The housing 28 receives the protruding end 7*a* of the key shaft and as the key is pushed fully home, in the direction of the arrow, the plunger 29 is moved to shift the micro-switch actuator 21*a***.

Figure 8:
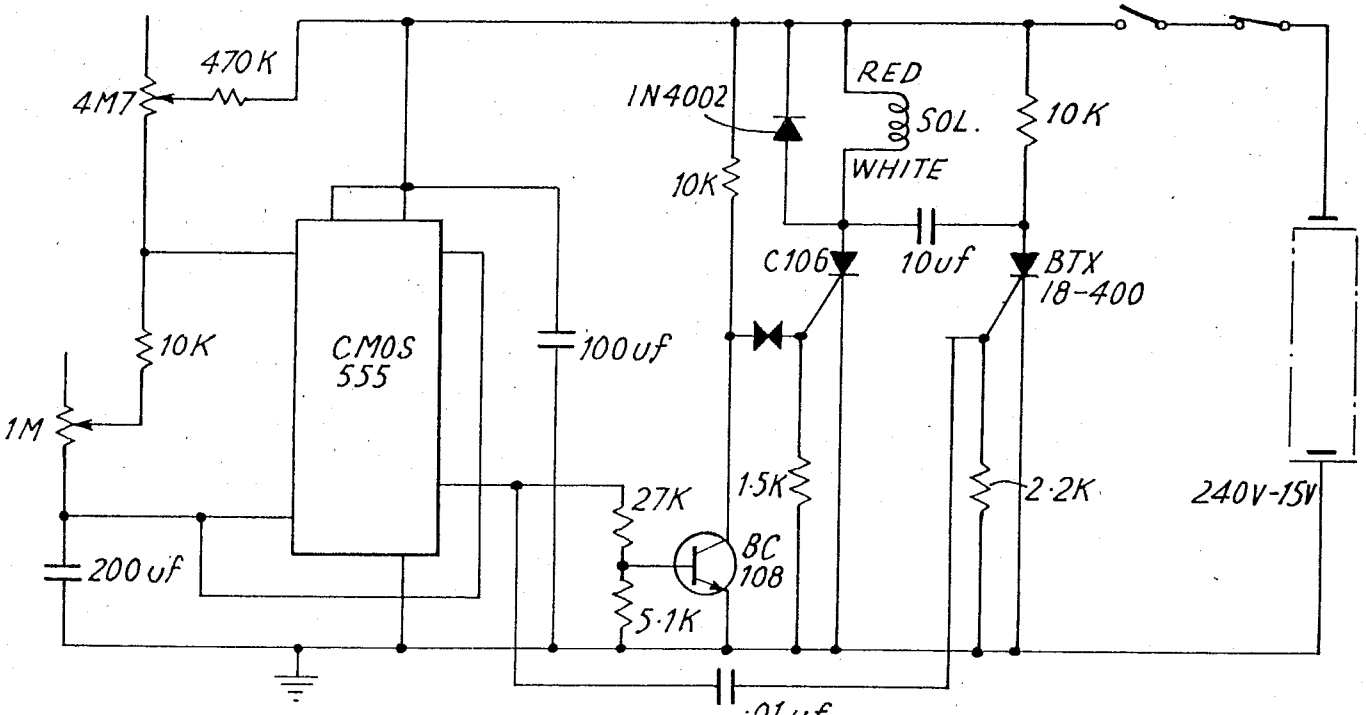
FIG. 8 is a circuit diagram of a first arrangement for control of the solenoid of the locks of FIGS. 1 and 4.

FIG. 8 shows a diagram for the electrical circuit as so far described.

Figure 9:
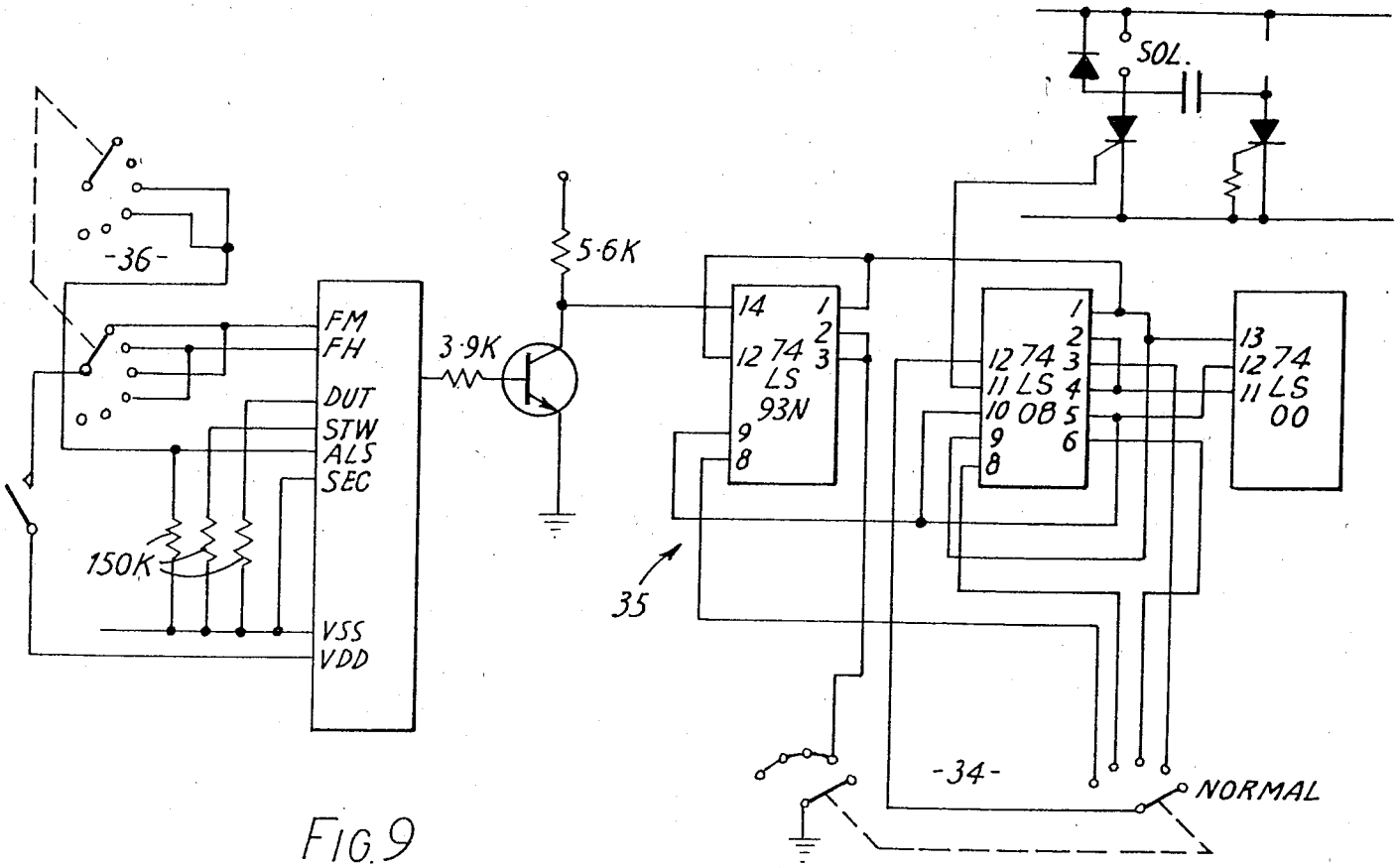
FIG. 9 is a circuit diagram of a second arrangement for said control which includes provision for inserting, into the time delay, one or more periods of 24 hours, as well as the normal time delay.

FIG. 9 shows a diagram for a modified circuit which allows for the introduction of selectable longer periods of time into the delay which is obtainable between insertion of the key into the lock, and the latching mechanism becoming actuated to move from latching position to unlatching position.

Figure 10:
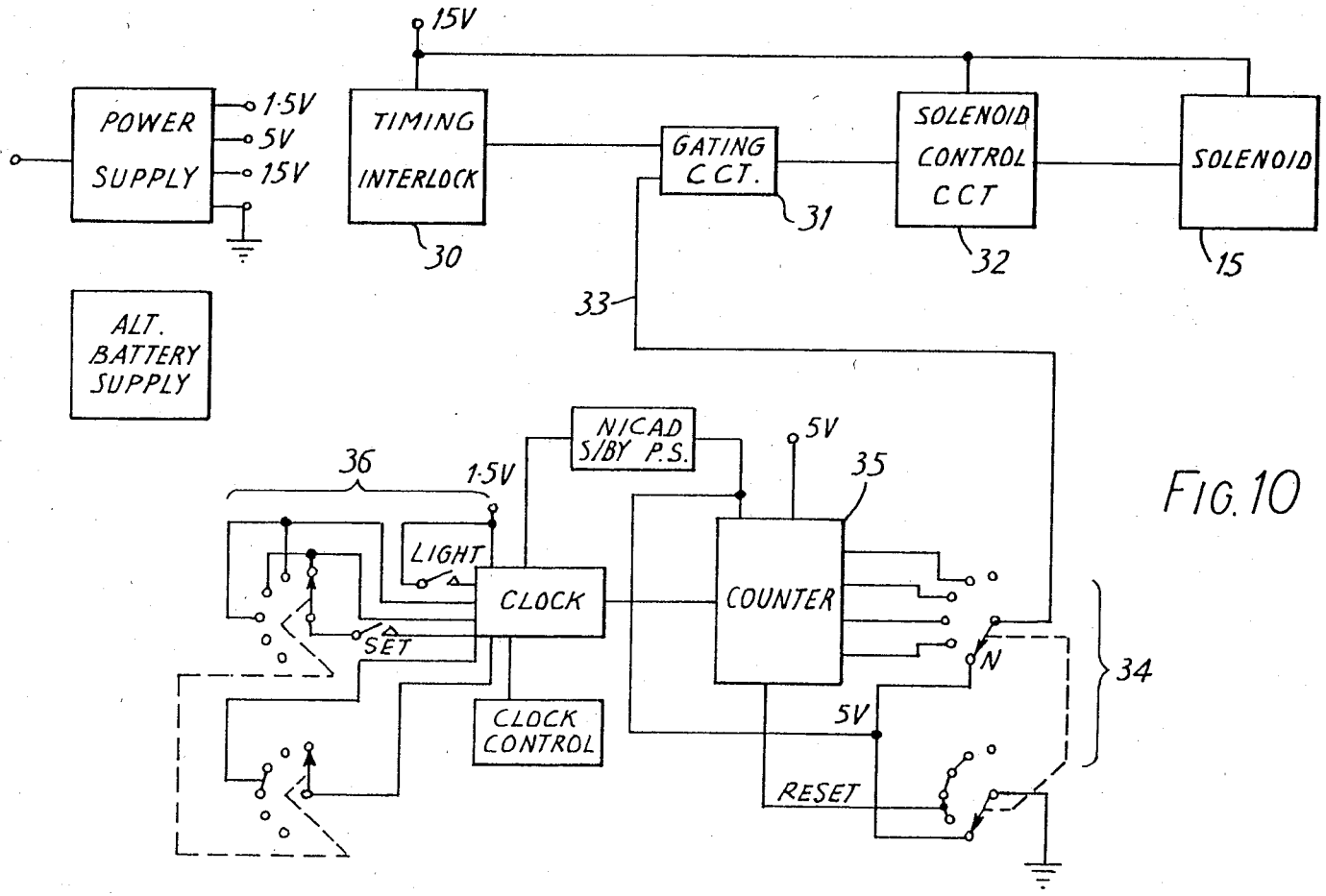
FIG. 10 is a functional diagram of the circuit of FIG. 9.

FIG. 10 shows the functional diagram corresponding to FIG. 9. Referring firstly to the upper part of FIG. 10 there is seen a timing interlock 30 which determines a first (shorter) period of time, say 0–60 minutes. Output from interlock 30 passes through a gating circuit 31 to a circuit 32 for controlling the operation of the solenoid 15. When only the delay appertaining to interlock 30 is to be used, the control line 33 of gating circuit 31 is earthed through the "N" (normal) contacts of ganged switches 34. When it is desired to insert, say, one, two, three or four additive periods of 24 hours each to the "normal" delay, the ganged switches 34 are set appropriately to position 1,2,3 or 4, thereby bringing into circuit the various outputs of a counter 35. The counter 35 essentially counts output signals from a clock circuit 36 (i.e. "real time") and an output is delivered from the counter, according to the switch position selected for switch 34, after the appropriate period of 24 hours or a multiple thereof, thereby releasing the gating circuit 31, such that the solenoid 15 only becomes actuated after the total additive time period of the counter circuit and the timing interlock. The current real time, i.e. time of day when setting, is set up by operation of the clock circuit 36.

The device can be fitted to many lever safe locks currently on the market, with a minimum of modification to the lock.

Figure 11:
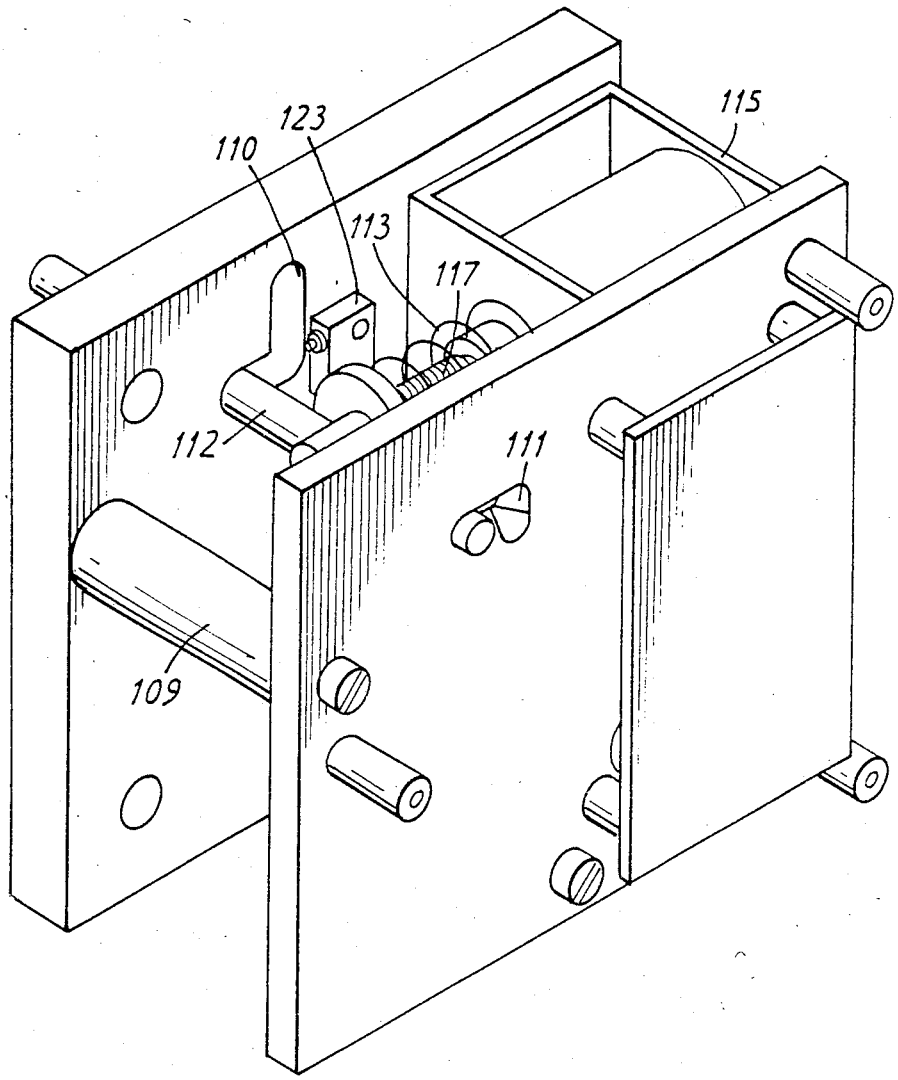
FIG. 11 is a perspective view of part of a lock in accordance with a further embodiment of the invention.
Figure 12:
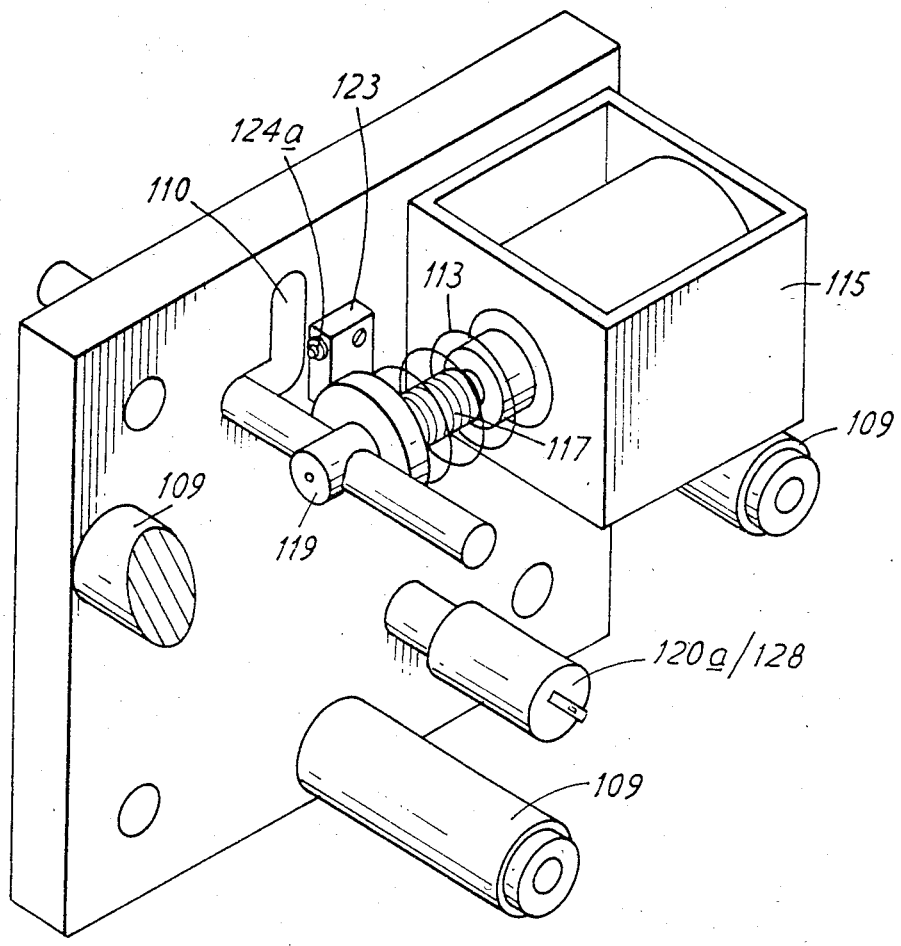
FIG. 12 is a view corresponding to FIG. 11 but with an outer wall removed.

Referring to FIGS. 11 and 12 there are shown minor variations in the structure of FIGS. 4–7, the corresponding parts being indicated by the same reference numerals but with the addition of 100. The L-shaped slot 10 of the lock of FIG. 1 is replaced by a modified slot 111 having a chamfered portion to permit the bar 112 to tilt when its other end rides up the vertical limb of L-shaped slot 110. The rod 119 is connected to the armature of solenoid 115 by the spring 117 and the torsion spring 113 extends coaxially therewith.

It will be appreciated that the invention is not restricted to the particular details described above with reference to the drawings and that numerous modifications and variations can be made without departing from the scope of the invention as defined in the following claims. For example, optical switches can be used operated by flags movable with the relevant component instead of the micro-switches shown. Further, an alarm can be provided to indicate when the latching member is in its unlatching position. The control circuit, including the timer can be located at a position remote from the lock and/or a back-up battery supply provided.

We claim:

1. In a key-operable lock having a movable bolt which is retained in its locking position by at least one movable locking member engaging the bolt but movable by rotation of a coacting key-bit of the key to release the bolt for movement to an unlocking position, the improvement wherein the lock further comprises a latching bar movable along a guide extending laterally of the bar between a latching position, in which the latching bar extends across the path of movement of the locking member to act as an abutment preventing movement of the locking member from its locking position to release the bolt, and an unlatching position; latch-control means acting on the latching bar to move said bar from its latching position to its unlatching position; switch means operable by movement of the key in the lock; and a timer actuated by the switch means and acting on the latch-control means to cause movement of the latching bar from its latching position to its unlatching position after a delay following operation of the switch means.

2. The lock according to claim 1, wherein the latching bar is resiliently biassed into its latching position.

3. The lock according to claim 1, wherein the bar also extends across said path when it is in its unlatching position and the guide terminates beyond the unlatching position of the bar to permit further movement of the bar with the locking member as the locking member moves to its unlocked position.

4. The lock according to claim 1, wherein the latch-control means is time-controlled so that it retains the latching bar in its unlatching position only for a predetermined time interval and thereafter allows or causes said bar to return to its latched position.

5. The lock according to claim 1, wherein the latch-control means comprises a solenoid in an electrical circuit with the switch means and the timer.

6. The lock according to claim 5, wherein a further switch means is provided which is actuable upon movement of the locking bar to its unlocking position to break the electrical circuit to the solenoid.

7. The lock according to claim 1, wherein the key-operated switch means has an actuator aligned with the rod of the key and arranged to actuate the switch upon full insertion of the key into the lock.

8. A lock control device for attachment to a key-operable lock having a movable bolt which is retained in its locking position by at least one movable locking member engaging the bolt but movable by rotation of a coacting key-bit of the key to release the bolt for movement to an unlocking position, said device comprising attachment means for securing the device to the lock; a latching bar adapted to extend into the lock and movable along a guide extending laterally of the bar between a latching position, in which the latching bar extends across the path of movement of the locking member to act as an abutment preventing movement of the locking member to release the bolt, and an unlatching position; latch-control means acting on the latching bar to move said bar from its latching position to its unlatching position; switch means adapted to be operated by movement of the key in the lock; and a timer actuated by the switch means and acting on the latch-control means to cause movement of the latching bar from its latched position to its unlatched position after a delay following operation of the switch means.

* * * * *